US006911990B2

(12) United States Patent
Selig et al.

(10) Patent No.: US 6,911,990 B2
(45) Date of Patent: Jun. 28, 2005

(54) FAST CLEAR TECHNIQUE FOR DISPLAY REGIONS HAVING SUBREGIONS

(75) Inventors: Calvin Selig, Fort Collins, CO (US); Roy Troutman, Fort Collins, CO (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 235 days.

(21) Appl. No.: 09/823,483

(22) Filed: Mar. 31, 2001

(65) Prior Publication Data

US 2002/0180758 A1 Dec. 5, 2002

(51) Int. Cl.[7] ..... G09G 5/00

(52) U.S. Cl. ..... 345/619; 345/620; 345/422; 345/590

(58) Field of Search ..... 345/619, 620, 345/422, 590, 592, 563, 502

(56) References Cited

U.S. PATENT DOCUMENTS 5,805,868 A * 9/1998 Murphy ..... 345/502
6,351,772 B1 2/2002 Murphy

* cited by examiner

*Primary Examiner*—Kimbinh T. Nguyen
(74) *Attorney, Agent, or Firm*—Kevin M. Hart

(57) ABSTRACT

A technique for performing clear operations in a region having a subregion. Responsive to a clear command: a current clear count for the region is left unchanged; a predetermined value is written into the pixels of the subregion; and the current clear count is written into pixel clear counts of the subregion. Prior to creating the subregion, clear commands may be handled according to a conventional fast clear technique. After creating the subregion and during the life of the subregion, clear commands may be handled according to the inventive technique. After the subregion is discontinued, clear commands may once again be handled according to the conventional technique. The inventive technique may be employed optionally depending on the percentage of the region's area occupied by the subregion.

29 Claims, 4 Drawing Sheets

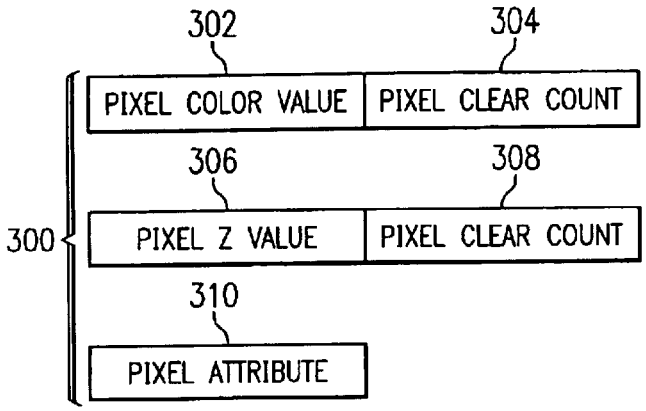
FIG. 3
FIG. 4
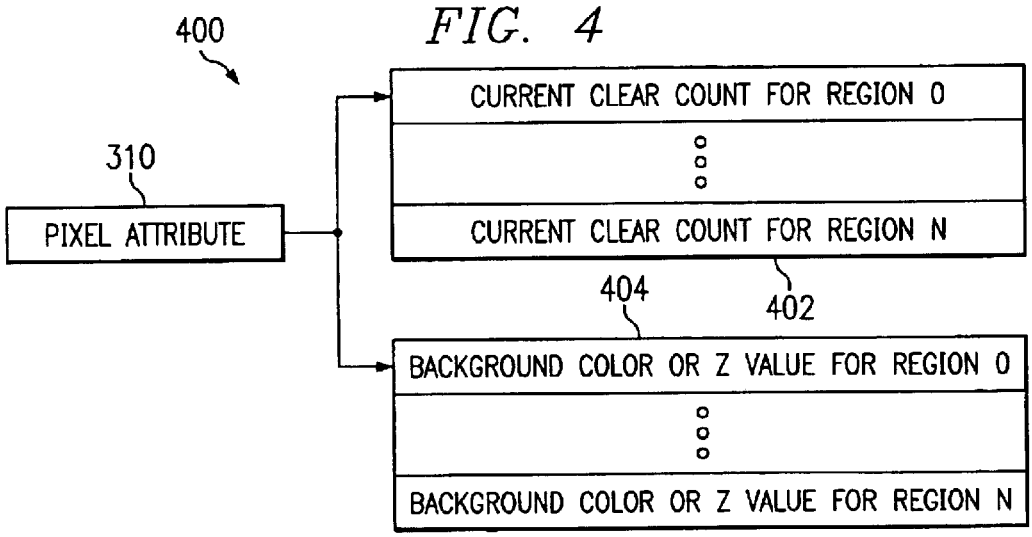
FIG. 5
(PRIOR ART)
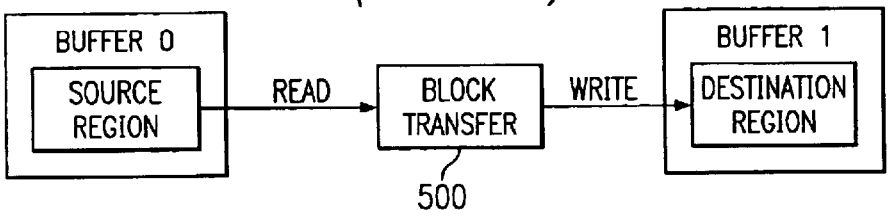

FAST CLEAR TECHNIQUE FOR DISPLAY REGIONS HAVING SUBREGIONS

RELATED APPLICATIONS

This application is related to the following copending U.S. patent applications: "Fast Clear Technique for Display Regions Having Subregions," filed Mar. 31, 2001 by Calvin Selig and Roy Troutman and assigned to Hewlett-Packard Company and "Technique for Eliminating Stale Information from a Computer Graphics Buffer," filed Mar. 31, 2001 by Calvin Selig, Ethan W. Gannett and Kendall F. Tidwell and assigned to Hewlett-Packard Company.

FIELD OF THE INVENTION

This invention relates generally to computer graphics, and more particularly to techniques for clearing and otherwise maintaining frame buffer memories in computer graphics systems.

BACKGROUND

In computer graphics, the operation of clearing a large area of frame buffer memory is very expensive in terms of both time and processing resources. For example, in a system having 1280×1024 resolution, clearing the frame buffer requires accessing more than one million pixels. Indeed, clearing such a large area of memory can require more time than it takes to draw a frame of an image after the clear has been completed. Designers have attempted to address this problem either by speeding up the process of clearing or by avoiding the process altogether.

Special-Purpose Memory Devices. Frame buffers have been implemented using special-purpose memory devices that have a hardware clear feature. On one hand, the operation of clearing frame buffer memory in such embodiments is accelerated. On the other hand, the special-purpose memory devices used to implement the frame buffer add significantly to the cost of the implementation.

Fast Clear Techniques. As an alternative to using expensive memory devices, it is possible to employ "fast clear" techniques to avoid writing data to a large number of pixel locations each time a clear command is issued by an application.

One such fast clear technique is taught in U.S. Pat. No. 5,851,447, issued to Michael D. Drews and assigned to Evans & Sutherland Computer Corporation (hereinafter "Drews"). Drews teaches allocating an additional field in frame buffer memory for each pixel and storing a version number in the additional field. An alternate pixel value (a clear value) and a current version number are maintained in a pixel processor. During frame buffer reads executed by the pixel processor, the version number corresponding to a pixel is read from the frame buffer first. If the version number read from the frame buffer is not equal to the current version number stored in the pixel processor, then the alternate pixel value stored in the pixel processor is substituted for the pixel value that would have been read from the frame buffer. On the other hand, if the version numbers are equal, then the pixel value is read from the frame buffer and used. According to this technique, multiple pixels in the frame buffer can be made to appear to have been modified simply by changing the current version number stored in the pixel processor. Thus, the frequency with which "real" clearing operations must be performed can be reduced.

Another fast clear technique is taught in U.S. patent application Ser. No. 09/283,336, filed by Jon Ashburn and Bryan Prouty on Mar. 31, 1999, titled "Improved Technique for Reducing the Frequency of Frame Buffer Clearing" (hereinafter "Ashburn"). Ashburn is hereby incorporated by reference in its entirety. Ashburn teaches apparatus and methods for operating in a fast clear mode without allocating additional fields per pixel beyond those already existing in a standard frame buffer memory. In addition, Ashburn teaches how the fast clear mode may be used in a windowed environment. The Ashburn fast clear mode may be used, for example, with inexpensive SDRAM frame buffer memory devices.

Stale Information and Ghost Images. One aspect of operating according to the fast clear techniques of the prior art is that the contents of the frame buffer memory do not necessarily reflect what is actually being displayed on the monitor of the computer graphics system. This is because, for a pixel whose version number or frame count does not match the current version number or frame count, the pixel contents read from the frame buffer memory are replaced with a predetermined value before displaying the pixel on the monitor. (Hereinafter, the term "stale information" will be used to describe data stored in a frame buffer memory at a pixel location whose version or frame number does not match the current version number or frame count.) As long as the graphics system remains in a fast clear mode, stale information in the frame buffer does not cause problems. But if the mode of the graphics system changes from a fast clear mode to a non fast clear mode, "ghost images" will suddenly appear as a result of stale information being displayed on the monitor.

For this reason, it was heretofore believed impractical to switch from a fast clear mode to a non fast clear mode during the life of a display region such as a window. Instead, a decision was typically made before creating a new window whether the window would employ fast clear mode or not, and the mode of operation once chosen would not be changed during the life of the window. But the necessity of having a static clear mode during the life of a window is quite limiting: For fast clear windows, operations cannot be performed if they would require the frame buffer contents to match the image being displayed. And for non fast clear windows, the important performance enhancements provided by fast clear techniques are not realized.

In addition, it is common for subregions to be created within an existing display region and then later discontinued. For example, one or more subwindows, scissor regions or viewports are sometimes created within an existing window. The prior art does not teach how to apply fast clear techniques when subregions are created within an existing display region.

It is therefore an object of the invention to provide fast clear techniques that may be applied when a subregion is created within an existing display region.

SUMMARY OF THE INVENTION

In one aspect, the invention includes a method of performing clear operations in a region having a subregion. Upon issuance of a clear command: a current clear count for the region is left unchanged; a predetermined pixel value (typically color or z) is written into each of the pixels of the subregion but not into the pixels outside the subregion; and the current clear count is written into pixel clear counts of the subregion but not into pixel clear counts outside the subregion.

In another aspect, the invention includes a method for performing clear operations in a region before, during and after the creation of a subregion: Prior to creation of the subregion, clear commands for the region are handled according to a conventional fast clear technique. After creation of the subregion and during the life of the subregion, clear commands are handled by: leaving a current clear count for the region unchanged; writing a predetermined pixel value (typically color or z) into each of the pixels of the subregion but not into the pixels outside the subregion; and writing the current clear count into pixel clear counts of the subregion but not into pixel clear counts outside the subregion. After the subregion is discontinued, clear commands for the region may once again be handled according to the conventional fast clear technique.

In still another aspect, the invention includes determining the percentage area of the region that is occupied by the subregion. If the percentage area is not higher than a predetermined threshold percentage, clear commands for the region and subregion may be handled according to the above-described technique. But if the percentage area is higher than the predetermined threshold percentage, clear commands for the region may be handled by alternative techniques.

BRIEF DESCRIPTION OF THE DRAWINGS

FIG. 3 is a block diagram illustrating example information that may be stored in association with a pixel in the buffers of FIG. 2.

FIG. 4 is a block diagram illustrating portions of a fast clear system that may be used in connection with the invention according to a preferred embodiment thereof.

FIG. 5 is a block diagram illustrating a prior art technique for using block transfer hardware in a computer graphics system.

DETAILED DESCRIPTION OF THE PREFERRED EMBODIMENTS

Figure 1:
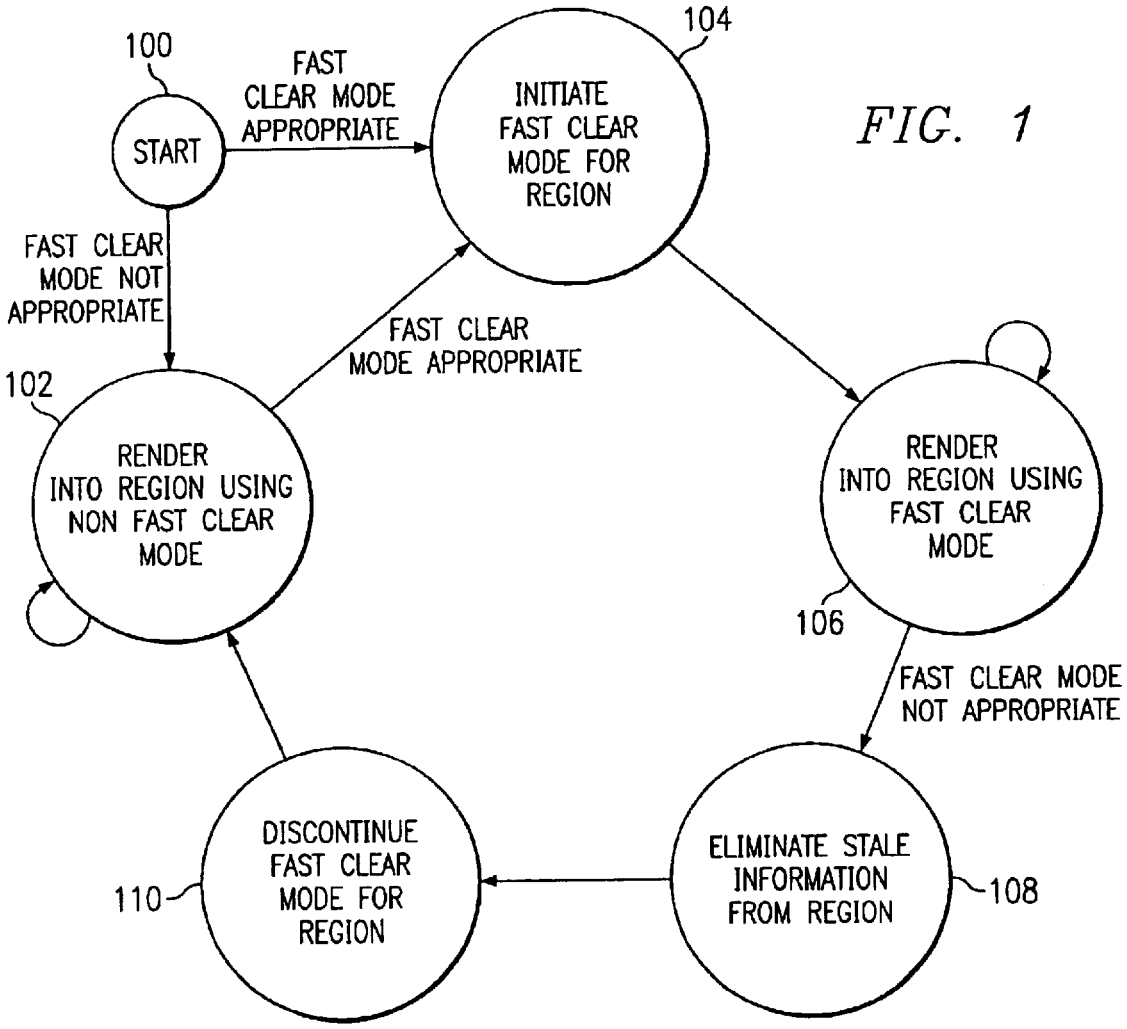
FIG. 1 is a state diagram illustrating a technique for switching from a fast clear mode to a non fast clear mode during the life of a display region by eliminating stale information from a graphics buffer.

Switching Clear Modes During the Life of a Display Region. FIG. 1 is a state diagram illustrating a technique for switching from a fast clear mode to a non fast clear mode during the life of a display region by eliminating stale information from a graphics buffer. Start state 100 may represent a time before, during or just after creation of a region of interest in the graphics buffer. The region of interest may be, for example, a window, subwindow or viewport. Throughout this document, use of any one of these specific terms during an explanation is meant to include the other terms also, as well as any term that could be used to describe a region of interest in a graphics buffer.

A determination may be made before or during start state 100 whether or not operation in a fast clear mode would be appropriate given the current state of the computer graphics system including the characteristics of the region of interest. For example, attribute bits corresponding to a window are typically used to identify a current clear count register in a fast clear system for use in fast clearing that window. In some circumstances, windows are forced to share an attribute number with other windows. Typically, such a circumstance would indicate that operation in fast clear mode would not be appropriate for the window, and rendering would begin in state 102 in a non fast clear mode. On the other hand, if the window has a unique attribute number or some other means is available to uniquely identify fast clear registers for the window, then operation in a fast clear mode would be appropriate, and the next state would be state 104.

In state 104, a predetermined value may be stored in a fast clear register corresponding to the region of interest. In the case of rendering to an image buffer, the predetermined value would typically be a color value—specifically, a background color value. An initial clear count for the region may be stored in a current clear count register corresponding to the region of interest. Alternatively, the clear count already resident in that register may be used.

In state 106, the graphics system may render into the region using the fast clear mode. The system may remain in state 106 indefinitely. It may happen, however, that circumstances change during the life of the region being rendered into. For example, window systems such as the well-known X Window System occasionally change the attribute assignment of an existing window in order to accommodate the creation of one or more new windows. Such a change in attribute assignments can mean that a window previously having a unique attribute assignment will now have to share an attribute number with one or more other windows. This would be one example of numerous circumstances in which fast clear mode would no longer be appropriate for a region of interest. Upon detecting such an occurrence, the system would transition to state 108, in which stale information is eliminated from the region. (Preferred techniques for eliminating stale information from the region will be discussed in further detail below.) In state 110, system settings may be modified so that fast clear mode is discontinued for the region. Rendering may then resume in state 102 using a non fast clear mode of operation. Whenever it becomes appropriate once again to resume fast clear mode for the region, the system may transition to state 104 from state 102.

Eliminating Stale Information from a Region. Table 1 below is a pseudocode representation of a preferred technique for eliminating stale information from a region of a graphics buffer.

TABLE 1

```
eliminateStaleInformationFromBufferRegion( regionPtr )
{
    for ( each pixel in region )
    {
      read pixelClearCount;
      optionally read pixelColorValue or pixelZValue;
      if ( pixelClearCount not equal to currentClearCount )
      {
        write predetermined color or z value into pixel;
        optionally write currentClearCount into pixelClearCount;
      }
```

TABLE 1-continued

```
        else
        {
            optionally write pixel color or z value back into pixel;
            optionally write pixelClearCount back into pixelClearCount;
        }
    }
}
```

As the pseudocode indicates, the following occurs for each pixel in the region: The clear count value associated with the pixel is read and compared with the current clear count for the region. (The clear count value associated with the pixel may be stored in one of the bit fields at the pixel's color or z value address. It may also be stored elsewhere in memory and merely associated with the pixel's color or z value address.) If the clear count value associated with the pixel is not equal to the current clear count for the region, then a predetermined value is written into the pixel color or z value.

Optionally the procedure may be designed so that every pixel value is read and written regardless of whether the pixel's clear count is current. In such an embodiment, the pixel value read will be written back into the pixel if the pixel clear count is current. But if the pixel clear count is not current, then the predetermined value is written back into the pixel in lieu of the pixel's previous value. In either embodiment, the current clear count for the region (or an alternative clear count value) may be written into the pixel's clear count in lieu of the pixel's previous clear count.

Figure 2:
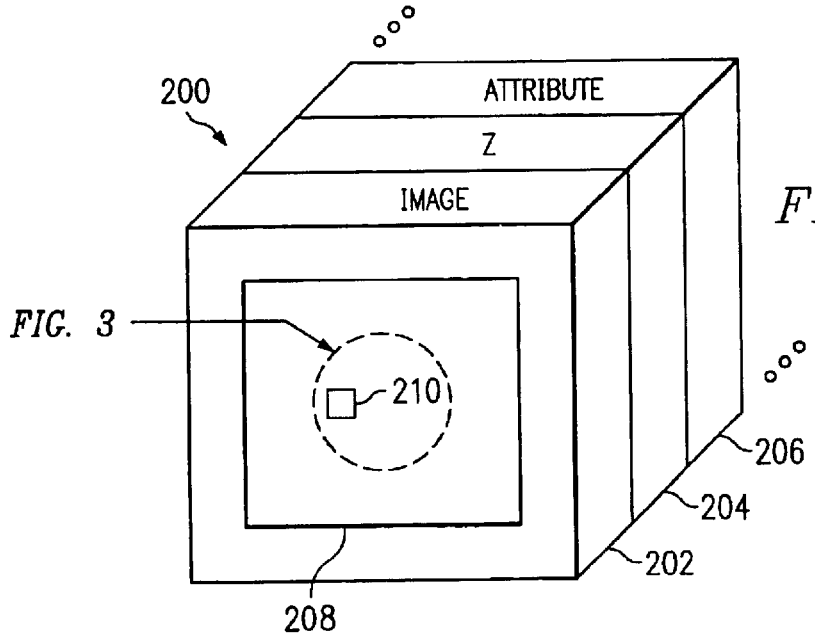
FIG. 2 is a block diagram illustrating a set of graphics buffers in an example host computer graphics system in which the invention may be employed.

Example Host System. FIGS. 2–4 illustrate portions of an example host computer graphics system in which aspects of the invention may be employed. Graphics buffer 200 may include numerous "planes" or buffers such as image buffer 202, z buffer 204 and attribute plane 206. Typically, a region of interest 208 would include numerous pixels 210. Depending on which buffer or plane is being accessed, the information 300 stored in association with a given pixel might include that shown in FIG. 3. In the image buffer, a pixel storage location might include a pixel color value 302 and a pixel clear count 304. In the z buffer, a pixel storage location might include a pixel z or depth value 306 and a pixel clear count 308. (Alternatively, pixel clear counts 304 and 308 may be stored elsewhere and associated with corresponding pixels.) In the attribute plane, one attribute number 310 might be stored for each pixel.

The host system would also typically include a fast clear system 400 similar to the ones taught by Ashburn or Drews (see above). Such a fast clear system may use the pixel attribute number 310 to select a current clear count and a predetermined color or z value for a region of interest. The current clear counts and predetermined color or z values may be stored in fast clear storage structures 402, 404, respectively.

Storage structures 402, 404 may take any suitable form such as, for example, registers or lookup tables. Optimally, a fast clear system 400 for use with the invention should have the capability to replace a color or z value with a predetermined value not only in the read path but also in the write path. Fast clear system 400 will have corresponding components in the display controller system as well as in the frame buffer controller system; the nature of such components will be apparent to those having ordinary skill in the art and having reference, for example, to Ashburn.

Use of Block Transfer Hardware and Fast Clear Hardware for High Performance Elimination of Stale Information from a Graphics Buffer. FIG. 5 illustrates a prior art method in which well-known block transfer (BLT or "blit") hardware 500 may be used to transfer pixel information from a source region in a first buffer (buffer 0) to a destination region in a second buffer (buffer 1) in a high-performance manner. Such block transfer hardware 500 is commonly used, for example, to transfer pixel information from a back (non-visible) buffer to a front (visible) buffer.

Figure 6:
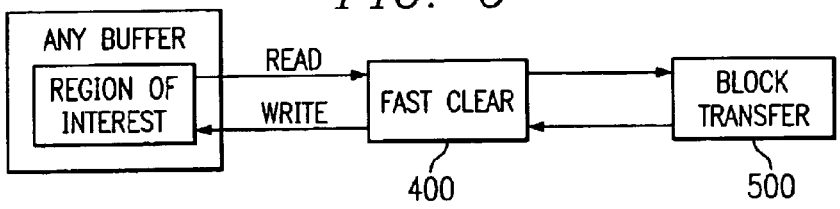
FIG. 6 is a block diagram illustrating a technique for using block transfer hardware and fast clear hardware to eliminate stale information from a computer graphics buffer in a high-performance manner.

Block transfer hardware 500 may be used in conjunction with fast clear hardware 400 to eliminate stale information from a graphics buffer in a high-performance manner, as illustrated in FIG. 6. In the technique of FIG. 6, the source region and the destination region for the block transfer operation are set to the same region (the region of interest). For each pixel location in the region, the pixel clear count is read and compared with a current clear count for the region. If the pixel clear count is not equal to the current clear count for the region, a predetermined value (such as a background color or default z value) is written back into the pixel.

Typically during a block transfer operation, every pixel in the source region is read, and every pixel in the destination region is written. Therefore, particularly beneficial results may be obtained in implementations wherein the pixel clear count is stored in one of the bit fields at the pixel's address (see FIG. 3). In such implementations, block transfer hardware and fast clear hardware may be used together to read both the pixel value and pixel clear count in one operation. If the pixel clear count is current, the pixel value and the pixel clear count may simply be written back into the pixel. But if the pixel clear count is not current, the predetermined pixel value may be written into the pixel. Either the current clear count for the region or some alternative count value may be written into the pixel clear count bit field.

Figure 7:
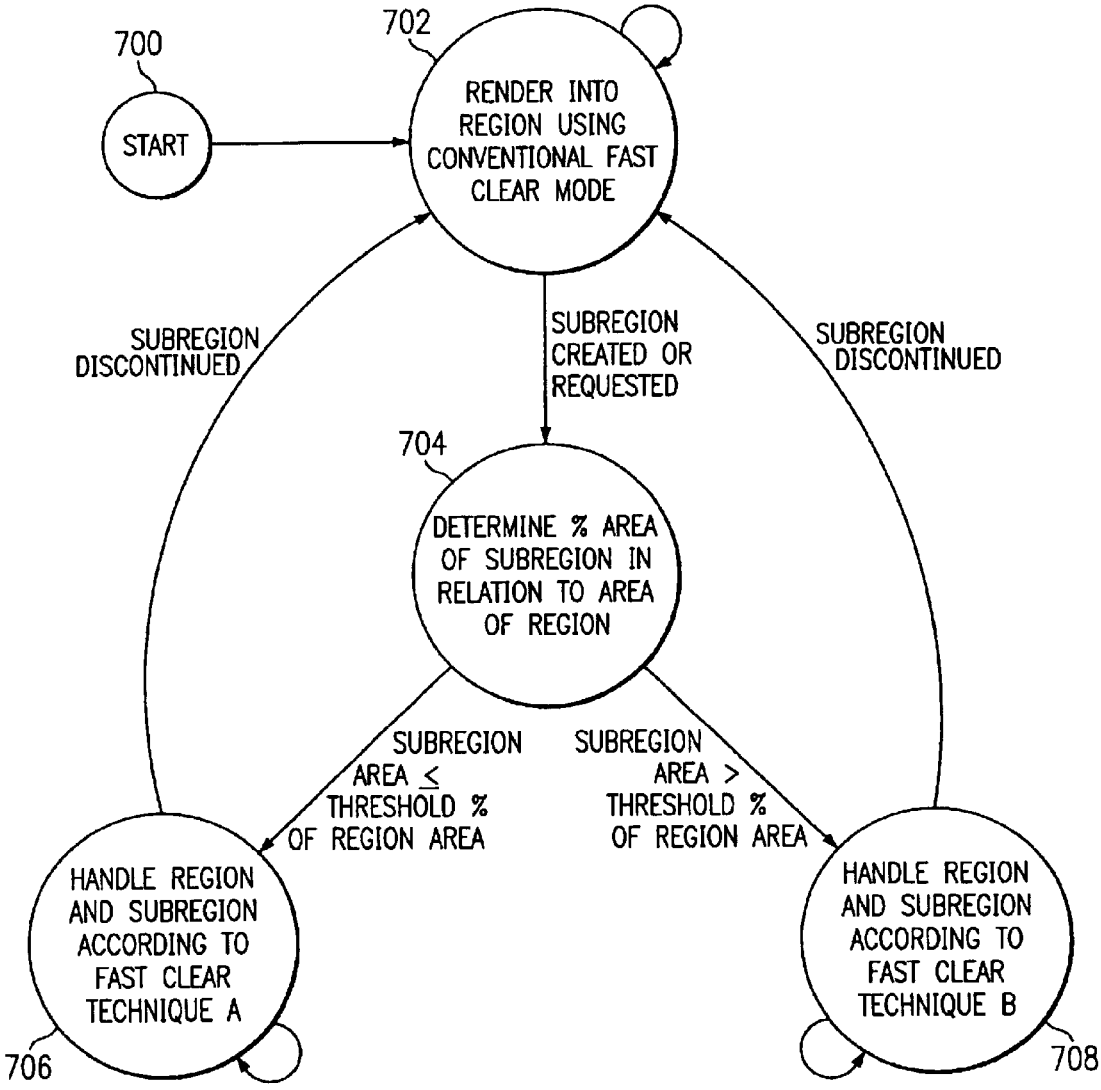
FIG. 7 is a state diagram illustrating first and second fast clear techniques that may be applied according to preferred embodiments of the invention when a subregion is created within an existing display region.

Fast Clear Techniques for Regions Having Subregions. FIG. 7 is a state diagram illustrating fast clear techniques according to preferred embodiments of the invention for use when a subregion is created within an existing display region. Upon transitioning from start state 700 to state 702, the graphics system may render into a region of interest, such as a window, using a conventional fast clear technique or using the techniques described above. The system may remain in state 702 indefinitely. Upon the creation of a subregion (such as a subwindow, scissor region or viewport), a determination may be made in state 704 concerning the size of the subregion. The area of the subregion is compared with the area of the region to determine the percentage of the region's area that will be occupied by the subregion. If the subregion's area will not be higher than a predetermined threshold percentage of the region's area, then operation may continue in state 706 wherein clear commands are handled according to a first technique (to be described in detail below with reference to Table 2). But if the subregion's area will be higher than a predetermined threshold percentage of the region's area, then operation may continue in state 708 wherein clear commands are handled according to a second technique (to be described in detail below with reference to Table 3). In one preferred embodiment, the threshold percentage may be about 75%. In another preferred embodiment, the threshold percentage may be about 70%. These or other threshold values may be chosen depending on the performance characteristics of the host computer graphics system.

Once in state 706 or 708, the system may remain in the same state indefinitely. When the subregion is discontinued, the system may simply transition back to state 702 and resume operation as before.

Figure 8A:
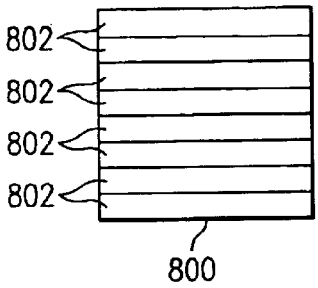
FIG. 8 is a block diagram illustrating the first fast clear technique of FIG. 7.
Figure 8B:
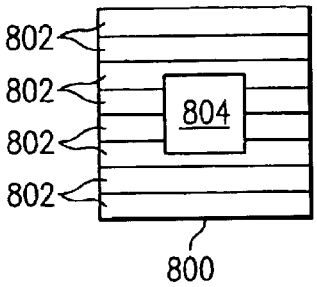
Figure 8C:
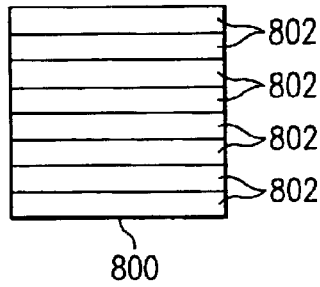

FIGS. 8A–8C are block diagrams illustrating the fast clear technique of state 706 (referred to in the drawing as fast clear technique A). FIG. 8A illustrates a region of interest 800 prior to creation of a subregion. Any conventional fast clear technique, such as a striping technique, may be utilized to handle clear commands for region 800. In accordance with a striping technique, region 800 may be divided into stripes 802. Alternatively, region 800 may be divided into vertical columns, or region 800 may be further divided into a matrix of rectangles. (The terms "subdivisions" and "stripes" and "striping" are used interchangeably herein to refer to any and all of these alternative stripes, columns or rectangles.) Responsive to each clear command, the current clear count for region 800 may be incremented, and then an actual clear may be performed in one of stripes 802. The one stripe 802 chosen for actual clearing may change according to a cyclic schedule so that all of stripes 802 will have been actually cleared at the completion of the cycle. The benefit of the striping technique is that an actual full clear of the entire striped area need not be performed in response to any one clear command, provided the number of stripes in the region is not greater than the maximum value of the current clear count register for the region; instead, the full clear is amortized over several clear commands.

Fast Clear Technique A for Regions Having Subregions. FIG. 8B illustrates region 800 after a subregion 804 has been created within it. Table 2 below is a pseudocode representation of a preferred technique for handling clear commands (according to fast clear technique A) for region 800 and subregion 804.

TABLE 2

```
handleClearCommandAccordingToTechniqueA
( ptrsToPertinentStructure )
{
    for( each pixel in subregion )
    {
        write predetermined color or z value into pixel;
        write currentClearCount into pixelClearCount;
    }
}
```

As the pseudocode in Table 2 indicates, when clear commands are received while operating according to technique A, the current clear count for region 800 need not be changed. Instead, an actual clear is performed for the pixels in subregion 804, and in the process the clear counts associated with the pixels in subregion 804 are set equal to the current clear count for region 800. The pixel values and clear counts for pixels outside subregion 804 need not be changed.

FIG. 8C illustrates region 800 after subregion 804 has been discontinued. As the drawing indicates, clear commands may then be handled according to whatever technique was being employed prior to creation of subregion 804.

Figure 9A:
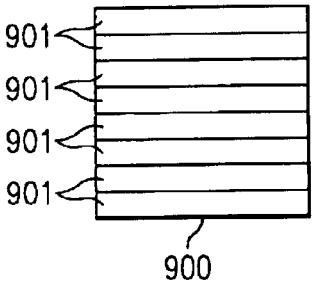
FIG. 9 is a block diagram illustrating the second fast clear technique of FIG. 7.

Fast Clear Technique B for Regions Having Subregions. FIGS. 9A–9D are block diagrams illustrating the fast clear technique of state 708 (referred to in the drawing as fast clear technique B). FIG. 9A illustrates a region of interest 900 prior to creation of a subregion. Any conventional fast clear technique may be utilized to handle clear commands for region 900. For example, region 900 may be divided into stripes or columns 901 in the same manner described above with reference to stripes or columns 802.

Figure 9B:
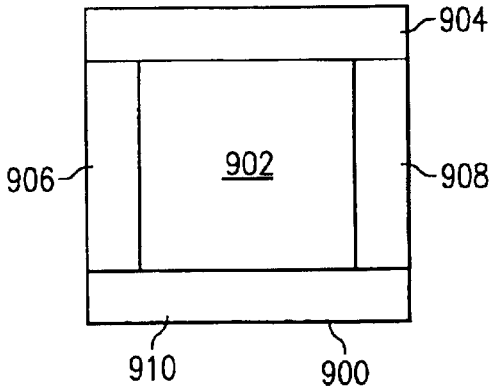

FIG. 9B illustrates region 900 after a subregion 902 has been created within it. Table 3 below is a pseudocode representation of a preferred technique for handling clear commands (according to fast clear technique B) for region 900 and subregion 902.

TABLE 3

```
handleClearCommandAccordingToTechniqueB ( ptrsToPertinentStructures )
{
    if( thisIsTheFirstClearCommandAfterCreationOfTheSubregion() )
    {
        /**********INITIALIZATION ROUTINE ALTERNATIVE 1******************/
        /** In alternative 1, the subregion is actually cleared,        **/
        /** but the current clear count for the region need not         **/
        /** be changed.                                                 **/
        eliminate stale information from pixels outside subregion;
        make pixelClearCounts equal for pixels inside and outside subregion
            (preferably make them all current);
        write predetermined color or z value into pixels inside subregion;
        /**********INITIALIZATION ROUTINE ALTERNATIVE 2******************/
        /** In alternative 2, the subregion need not actually be        **/
        /** cleared, but the current clear count for the region         **/
        /** is updated.                                                 **/
        eliminate stale information from pixels outside subregion;
        update current clear count for region;
        write updated current clear count for region into all
            pixelClearCounts outside the subregion;
    }
    else
    {
        update current clear count for region;
        write updated current clear count for region into all
            pixelClearCounts outside the subregion;
    }
}
```

As the pseudocode in Table 3 indicates, according to technique B a distinction is made between the first clear command after creation of the subregion and subsequent clear commands. Upon issuance of the first clear command after creation of the subregion, at least two alternative initialization routines may be employed. In alternative 1, stale information is eliminated from the area outside the subregion; all pixelClearCounts inside and out are made current; and the subregion is actually cleared. In alternative 1, the current clear count for the region need not be changed. In alternative 2, stale information is eliminated from the area outside the subregion; the current clear count for the region is updated (effectively "clearing" the subregion without actually clearing it); and the pixelClearCounts in the area outside the subregion are made current. It should be understood that one or the other alternative would be employed to perform the initialization routine in a given circumstance; not both.

Upon issuance of subsequent clear commands, all that needs to be done to process a clear command is to update the clear count for the region and to write the updated region clear count into the pixelClearCounts outside the subregion. This has the effect of "clearing" the subregion while maintaining the information outside the subregion.

Figure 9C:
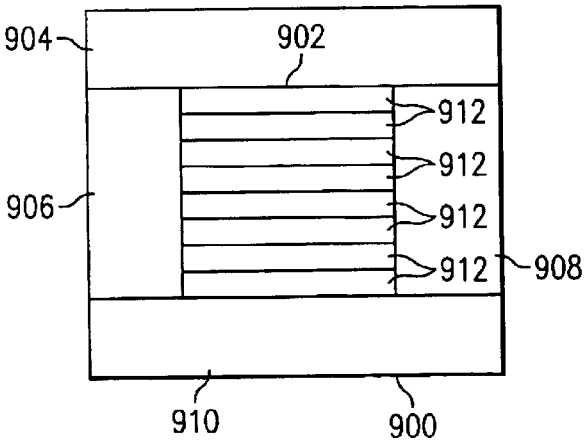

It should be noted that, if striping is performed inside the subregion, the stripe sizes need not be recalculated to fit the subregion as shown in FIG. 9C. Instead, the stripe sizes may remain as they were calculated for the base region as shown in FIG. 9A. In such a mode, clip settings may cause some stripe clear operations to be discarded because they are outside the clip area of subregion 902.

It should also be noted that, in both of fast clear techniques A and B described above, the pixel information outside the subregion is kept current. Therefore, the predetermined pixel values stored in fast clear storage structures 402, 404 may be changed for the duration of the subregion relative to what they were prior to the existence of the subregion. For example, the subregion may be made to have a different background color than the area outside the subregion simply by replacing the appropriate predetermined color value in structure 402 for the duration of the subregion's existence. The value may be restored to its original value when the subregion is discontinued.

In a preferred embodiment, the area outside the subregion may be divided into four rectangular subareas 904, 906, 908, 910. In this manner, block transfer hardware 500 and conventional area fill techniques may be utilized to enhance performance when manipulating pixel values and clear count values for the pixels outside the subregion. In a further preferred embodiment, after the initial clear has been performed in subregion 902, the striping techniques described above may be employed within subregion 902 using stripes or columns 912. (See FIG. 9C.)

Figure 9D:
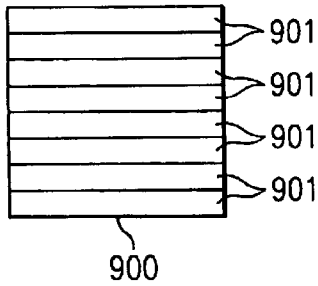

FIG. 9D illustrates region 900 after subregion 902 has been discontinued. As the drawing indicates, clear commands may then be handled according to whatever technique was being employed prior to creation of subregion 902.

CONCLUSION

While the invention has been described in detail with reference to preferred embodiments thereof, the described embodiments have been presented by way of example and not by way of limitation. For example, the techniques described may be applied to any type of graphics buffer. Moreover, the techniques may be implemented in hardware, software, or in a hybrid hardware/software manner. In one embodiment, the invention was implemented with driver software in conjunction with the hardware described above.

What is claimed is:

1. A method of performing clear operations in a region having a subregion, comprising:

responsive to a clear command:

leaving a current clear count for the region unchanged;

writing a predetermined value into each of the pixels of the subregion, but not into the pixels outside the subregion; and writing the current clear count into clear count storage locations corresponding to each of the pixels of the subregion, but not into clear count storage locations corresponding to the pixels outside the subregion.

2. The method of claim 1, wherein the subregion is a scissor region.

3. The method of claim 1, wherein the subregion is a viewport.

4. The method of claim 1, wherein the predetermined value is a color value.

5. The method of claim 4, wherein the color value, is the same as a background color outside the subregion.

6. The method of claim 4, wherein the color value is different than a background color outside the subregion.

7. The method of claim 1, wherein the predetermined value is a z value.

8. A method of performing clear operations in a region having a subregion, comprising:

prior to creation of the subregion, responding to clear commands for the region according to a fast clear technique;

after creation of the subregion and during the life of the subregion, responding to clear commands for the region by:

leaving a current clear count for the region unchanged;

writing a predetermined value into each of the pixels of the subregion, but not into the pixels outside the subregion; and writing the current clear count into clear count storage locations corresponding to each of the pixels of the subregion, but not into clear count storage locations corresponding to the pixels outside the subregion; and after discontinuance of the subregion, resuming responding to clear commands for the region according to the fast clear technique.

9. The method of claim 8, wherein the resuming step occurs without changing the current clear count for the region.

10. The method of claim 8, wherein the fast clear technique is a striped fast clear technique.

11. The method of claim 10, wherein the resuming step occurs without changing stripe definitions for the region.

12. The method of claim 8, wherein the subregion is a scissor region.

13. The method of claim 8, wherein the subregion is a viewport.

14. The method of claim 8, wherein the predetermined value is a color value.

15. The method of claim 14, wherein the color value is the same as a background color outside the subregion.

16. The method of claim 14, wherein the color value is different than a background color outside the subregion.

17. The method of claim 8, wherein the predetermined value is a z value.

18. A method of performing clear operations in a region having a subregion, comprising:

determining the percentage area of the region occupied by the subregion; and if the percentage area is not higher than a predetermined threshold percentage, responding to clear commands for the region by:

leaving a current clear count for the region unchanged;

writing a predetermined value into each of the pixels of the subregion, but not into the pixels outside the subregion; and writing the current clear count into clear count storage locations corresponding to each of the pixels of the subregion, but not into clear count storage locations corresponding to the pixels outside the subregion.

19. The method of claim 18, wherein the predetermined threshold percentage is about 75%.

20. The method of claim 18, wherein the predetermined threshold percentage is about 70%.

21. The method of claim 18, wherein the subregion is a scissor region.

22. The method of claim 18, wherein the subregion is a viewport.

23. The method of claim 18, wherein the predetermined value is a color value.

24. The method of claim 23, wherein the color value is the same as a background color outside the subregion.

25. The method of claim 23, wherein the color value is different than a background color outside the subregion.

26. The method of claim 18, wherein the predetermined value is a z value.

27. Computer program code embodied in a machine-readable storage or transmission medium which, when executed on a computer, causes the computer to perform a method of performing clear operations in a region having a subregion, comprising:

responsive to a clear command:

leaving a current clear count for the region unchanged;

writing a predetermined value into each of the pixels of the subregion, but not into the pixels outside the subregion; and writing the current clear count into clear count storage locations corresponding to each of the pixels of the subregion, but not into clear count storage locations corresponding to the pixels outside the subregion.

28. Computer program code embodied in a machine-readable storage or transmission medium which, when executed on a computer, causes the computer to perform a method of performing clear operations in a region having a subregion, comprising:

prior to creation of the subregion, responding to clear commands for the region according to a fast clear technique;

after creation of the subregion and during the life of the subregion, responding to clear commands for the region by:

leaving a current clear count for the region unchanged;

writing a predetermined value into each of the pixels of the subregion, but not into the pixels outside the subregion; and writing the current clear count into clear count storage locations corresponding to each of the pixels of the subregion, but not into clear count storage locations corresponding to the pixels outside the subregion; and after discontinuance of the subregion, resuming responding to clear commands for the region according to the fast clear technique.

29. Computer program code embodied in a machine-readable storage or transmission medium which, when executed on a computer, causes the computer to perform a method of performing clear operations in a region having a subregion, comprising:

determining the percentage area of the region occupied by the subregion; and if the percentage area is not higher than a predetermined threshold percentage, responding to clear commands for the region by:

leaving a current clear count for the region unchanged;

writing a predetermined value into each of the pixels of the subregion, but not into the pixels outside the subregion; and writing the current clear count into clear count storage locations corresponding to each of the pixels of the subregion, but not into clear count storage locations corresponding to the pixels outside the subregion.

* * * * *